United States Patent [19]

Ciko et al.

[11] 4,202,800

[45] May 13, 1980

[54] LIQUID LAUNDRY DETERGENT COMPRISING A NONIONIC SURFACTANT AND AN ALKANOLAMINE

[75] Inventors: John D. Ciko, Lindenhurst, Ill.; Robert A. Ward, Cleveland Heights, Ohio; John J. Cramer, Grosse Ile, Mich.

[73] Assignee: BASF Wyandotte Corporation, Wyandotte, Mich.

[21] Appl. No.: 812,452

[22] Filed: Jul. 5, 1977

Related U.S. Application Data

[63] Continuation-in-part of Ser. No. 628,357, Nov. 3, 1975, abandoned.

[51] Int. Cl.[2] ..... C11D 1/66; C11D 3/30

[52] U.S. Cl. ..... 252/543; 252/153; 252/548; 252/DIG. 14; 252/DIG. 15

[58] Field of Search ..... 252/548, 153, 544, DIG. 14, 252/DIG. 15, DIG. 1, 543

[56] References Cited

U.S. PATENT DOCUMENTS

| | | | |
|---|---|---|---|
| 3,232,880 | 2/1966 | Mausner et al. | 252/DIG. 14 X |
| 3,869,399 | 3/1975 | Collins | 252/118 |
| 3,876,563 | 4/1975 | Collins | 252/545 |
| 3,886,098 | 5/1975 | DiSalvo et al. | 252/540 |
| 3,953,380 | 4/1976 | Sundby | 252/548 X |

FOREIGN PATENT DOCUMENTS 976831 10/1975 Canada .

*Primary Examiner*—Harris A. Pitlick
*Attorney, Agent, or Firm*—John W. Linkhauer

[57] ABSTRACT

Excellent liquid laundry-detergent compositions are obtained by combining (1) alkanolamine, (2) nonionic surfactant, (3) sodium carboxymethylcellulose, (4) fabric brightener(s), (5) solvent, and (6) water. The preferred compositions of the invention also usually contain optional ingredients, such as dyes and perfumes. The alkanolamines promote the action of the nonionic surfactants. Moreover, it is desirable to use some triethanolamine for its stabilizing effect. The mixture of alkanolamine and nonionic surfactants is compatible with sodium carboxymethylcellulose, an excellent agent for avoiding redeposition of soil. The compositions according to the invention have good detergent activity when used at temperatures such as 49 to 60 degrees Centigrade. They afford a liquid laundry detergent which is at least as active, pound for pound, as powder laundry detergents now in common use.

18 Claims, No Drawings

LIQUID LAUNDRY DETERGENT COMPRISING A NONIONIC SURFACTANT AND AN ALKANOLAMINE

CROSS-REFERENCES TO RELATED APPLICATION

This application is in part a continuation of our earlier-filed application, Ser. No. 628,357, filed Nov. 3, 1975, now abandoned.

BACKGROUND OF THE INVENTION

1. Field of the Invention:

This invention relates to laundry detergents, and in particular, to a liquid laundry detergent.

2. Description of the Prior Art:

Prior to the present invention, the most effective laundry detergents have usually been powdered products. Liquid laundry detergents have been known, but in most instances, they have had the drawback that they are not, on an equal-weight basis, as effective as the known powder products.

There are several problems which must or should be taken into account in the preparation of a satisfactory liquid laundry detergent.

One problem is stability. A composition which undergoes substantial changes between when it is formulated and when it can be expected to be used, considering the environments to which it is likely to be exposed, is not one that is useful. There are various kinds of instability. Sometimes a few hours or days of exposure to light or to atmospheric oxygen causes a change; sometimes it takes a few weeks. Some compositions do not withstand the cold or the heat that they would sometimes encounter in being shipped.

Another problem is compatibility. There are compositions which may even perform adequately but, when they are initially composed, are turbid or even non-homogeneous. Naturally, a composition which is turbid or non-homogeneous is commercially very undesirable in comparison to one lacking such a disadvantage.

However stable and compatible a composition may be, it is useless if it does not perform adequately as a laundry detergent. It must wash both natural and synthetic fibers and blends of such fibers. It must give good soil removal and good whiteness retention. The detergent must not damage or roughen the fabrics, or unduly shorten their service lives. It must not be so toxic as to endanger its user, or have a displeasing odor or color, or leave any color or odor on the clothes, or foam too much, or cost too much. It must not remove, along with soil, any permanent-press resin treatment on the fabric. It must not, as an all-purpose laundry detergent, itself have a bleaching effect. It must, to obtain adequate performance in comparison with present commercial products, contain some adequate soil-anti-redeposition agent, and usually one or more fabric-brightener agents as well. It should not contain components which are non-biodegradable or would otherwise render it ecologically undesirable. It must not require conditions of manufacture which are intolerably hazardous.

Even if a composition meets all the above requirements, it can be unsatisfactory—for example, if the composition achieves stability or compatibility only by the inclusion of a fairly large percentage of organic solvent, there can be obtained a composition which is satisfactory in most respects, except for its ability to be shipped easily. Any material with too low a flash point is subject, in shipping, to stringent regulations that add to its cost in the hands of the consumer.

It has been usual, in compounding liquid laundry-detergent compositions, to promote the action of the surfactants by including in the composition an inorganic builder. Most of the known liquid laundry-detergent compositions, thus, comprise a mixture of organic and inorganic components, and the mixture has limited solubility in water.

The concept of promoting the action of nonionic surfactants by including with them an alkanolamine such as monoethanolamine or triethanolamine is not completely new. U.S. Pat. No. 3,869,399, issued Mar. 4, 1975, discloses a concentrated liquid detergent which comprises a mixture of a nonionic surfactant, an anionic surfactant, and ethanolamine. U.S. Pat. No. 3,876,563, issued Apr. 8, 1975, describes a liquid detergent which contains a nonionic surfactant, a zwitterionic surfactant, ethanolamine, and a solvent. These patents teach that the ethanolamine component in such a detergent serves several purposes, such as reducing the viscosity, improving the stability, and acting as a buffering agent. The above-mentioned patents do not, however, lead those skilled in the art to believe that, as we have discovered, excellent liquid laundry-detergent compositions can be made which do not contain anionic or zwitterionic surfactants. These patents do not give those skilled in the art any basis for knowing that liquid laundry-detergents can be made which contain the nonionic surfactant(s), an ethanolamine component, and sodium carboxymethylcellulose. It has not been known that it would be possible to obtain a composition in which fabric brightener(s) and sodium carboxymethylcellulose are compatible with nonionic surfactants and an alkanolamine used to promote the action of such surfactants.

SUMMARY OF THE INVENTION

Excellent liquid laundry-detergent compositions are obtained by combining (1) alkanolamine, (2) nonionic surfactant, (3) sodium carboxymethylcellulose, and (4) water. They may also contain (5) one or more fabric brighteners, and/or (6) one or more solvents. The preferred compositions of the invention also usually contain optional ingredients, such as dyes and perfumes. The alkanolamines promote the action of the nonionic surfactants. Moreover, it is desirable to use some triethanolamine for its stabilizing effect. The mixture of alkanolamine and nonionic surfactants is compatible with sodium carboxymethylcellulose, an excellent agent for avoiding redeposition of soil. The compositions according to the invention have good detergent activity, especially when used at temperatures such as 49 to 54.5 degrees Centigrade. They afford a liquid laundry-detergent which is at least as active, pound for pound, as powder laundry detergents now in common use.

DESCRIPTION OF PREFERRED EMBODIMENTS

In its broadest aspect, the present invention concerns liquid laundry-detergent compositions which are satisfactory in view of the many and various criteria discussed above. The compositions contain one or more non-ionic surfactants, an alkanolamine component comprising one or more alkanolamines to promote the action of the nonionic surfactant(s), and sodium carboxymethylcellulose as an agent to prevent the redeposition of soil. In a more limited aspect, the compositions also contain one or more compatible fabric brighteners. The invention further concerns the use of one or more monoalkanolamines, alone or with other alkanolamines, as organic builders in a liquid laundry detergent. In an aspect of the invention still more limited, there is provided a liquid laundry detergent of the kind indicated above in which good stability and shelf-life is imparted by selecting triethanolamine as a substantial part of the alkanolamine content. In an aspect of the invention still more limited, there is provided a composition which also contains a suitable solvent component, such as isopropanol, ethanol, or the n-butyl ether of diethylene glycol (butyl Carbitol) and, desirably but not necessarily, additional compatible ingredients such as dyes and perfumes.

Compositions according to the invention contain a nonionic surfactant component. The nonionic surfactant component is ordinarily present to the extent of approximately 15 to 30 weight percent of the composition. Desirably, the nonionic surfactant component comprises a mixture of two or more nonionic surfactants, for example, one of a relatively hydrophilic nature and one of a relatively hydrophobic nature, though satisfactory results may sometimes be obtained with the use of one nonionic surfactant having an HLB value of 5 to 14.

The term "HLB" stands for "hydrophilic-lipophilic balance". Various surfactants have been assigned HLB numbers which run from 1 (extremely lipophilic) to about 30 or even 80 (extremely hydrophilic). Further information appears on pages 479–480, *Surface Active Agents and Detergents,* volume II, by A. M. Schwartz, J. W. Perry, and J. Berch (Interscience Publishers, Inc., New York, 1958). A comprehensive list of commercially available detergents and emulsifiers, arranged in order of HLB number, appears at pages 17 to 33 of McCutcheon's *Detergents and Emulsifiers,* 1975 North America Edition, (M C Publishing Co., Glen Rock, N.J., 1975).

In particular, we have obtained excellent results with the use, as a hydrophilic nonionic surfactant, of a product having an average molecular weight of 1050 and based on a mixture of straight-chain higher alcohols containing 12 to 16 carbon atoms, oxyalkylated with a 1:3 mixture of propylene oxide and ethylene oxide to produce a heterically alkoxylated nonionic surfactant. Such a product is sold by BASF Wyandotte Corporation under the trademark "PLURAFAC B-26", and has an HLB number of 15. Those skilled in the art will appreciate, however, that other nonionic surfactants of hydrophilic nature, i.e., having an HLB number of 11 to 17 could also be used in place of the particular hydrophilic nonionic surfactant discussed above. Among the other hydrophilic nonionic surfactants which may be used in place of "PLURAFAC B-26" surfactant are the surfactants commercially available and sold under the names "Tergitol 15-S-9", "Triton X-100", and "Neodol 25-7". "Tergitol 15-S-9" is nominally a mixture of $C_{11}$ to $C_{15}$ linear primary alkanols, reacted with an average of 9 oxyethylene units. "Triton X-100" is nominally octylphenol, reacted with an average of 9 to 10 oxyethylene units. "Neodol 25-7" is nominally a mixture of $C_{12}$ to $C_{15}$ linear primary alkanols, reacted with an average of 7 oxyethylene units.

We have obtained excellent results by using, as the relatively hydrophobic nonionic surfactant, a material based upon straight-chain alcohols containing 12 to 15 carbon atoms and oxyethylated to an average molecular weight of 350; such material is sold by BASF Wyandotte Corporation under the trademark "PLURAFAC A-24". Such material has an HLB number of 6. Those skilled in the art will appreciate, however, that other relatively hydrophobic nonionic surfactants having an HLB number of 4 to 8 may similarly be used.

Among the other hydrophobic nonionic surfactants which may be used in place of "PLURAFAC A-24" are the surfactants commercially available and sold under the names "Drewmulse SML", "Span 80", "Drewpol 10-4-0", "PLURONIC L-72", "Neodol 25-3" and "Triton X-35". Of these, the first three are sorbitan monolaurate, sorbitan monooleate, and decaglycerol tetraoleate, respectively. "PLURONIC L-72" is nominally a nonionic block copolymer based upon propylene glycol oxypropylated to an average molecular weight of oxypropylene hydrophobe of 2050 and then capped with oxyethylene units to give an overall average molecular weight of 2750. "Neodol 25-3" is nominally a mixture of $C_{12}$ to $C_{15}$ linear primary alcohols, reacted with an average of 3 oxyethylene units. "Triton X-35" is nominally octylphenol reacted with an average of 3 oxyethylene units.

Satisfactory results are obtained with a 1:1 weight-ratio blend of the two nonionic surfactants mentioned above, but those skilled in the art will appreciate that, depending upon the surfactants chosen, the ratio thereof can be varied to suit requirements.

It is not absolutely necessary to use a blend of nonionic surfactants. In some instances, adequate results may be obtained by using a single nonionic surfactant. For example, there may be used a material based upon straight-chain alcohols containing 12 to 15 carbon atoms and oxyalkylated with a 2:1 mixture of propylene oxide and ethylene oxide to an approximate molecular weight of 350 and then further oxyalkylated with a 2:1 mixture of ethylene oxide and propylene oxide to an average molecular weight of 950. Such a product is sold by BASF Wyandotte Corporation under the trademark "PLURAFAC D-25". Such material has an HLB number of 10.

Similarly, there may also be used a material based upon straight-chain alcohols containing 12 to 15 carbon atoms and oxyalkylated with a 2:1 mixture of ethylene oxide and propylene oxide to an average molecular weight of 625. Such material is sold by BASF Wyandotte Corporation under the trademark "PLURAFAC RA-30" and has an HLB number of 8. In some instances, this material may be substituted for the "PLURAFAC A-24" surfactant material discussed above, serving as the hydrophobic component of a blend of nonionic surfactants.

Liquid laundry-detergent compositions in accordance with the invention contain 0.15 to 0.50 weight percent of sodium carboxymethylcellulose, an excellent agent for preventing the redeposition of soil.

Compositions in accordance with the invention contain 10 to 30 weight percent of an alkanolamine component. This component may comprise one or more of the following: monoethanolamine, diethanolamine, triethanolamine, diethylethanolamine, triisopropanolamine, and dimethylethanolamine. In comparative tests, it was established that, in general, greater detergent effectiveness is obtained when a monoalkanolamine is used in place of an equal weight of a higher alkanolamine. Thus, monoethanolamine outperforms diethanolamine, which outperforms triethanolamine. This is not, however, the only consideration; we have also discovered that the stability of the resulting liquid laundry detergent is improved if some effective proportion of triethanolamine is used. We have obtained good results with a mixture of equal weights of monoethanolamine and triethanolamine as the alkanolamine component.

It is usually desirable to include, in liquid laundry-detergent compositions according to the invention, a small proportion of a suitable solvent. Satisfactory results have been obtained with the use of isopropanol or the n-butyl ether of diethylene glycol. Other solvents which may also be used include ethanol, n-propanol, the ethyl ether of diethylene glycol, 2-ethoxyethanol, and 2-butoxy ethanol. Mixtures of such compounds may also be used. In general, it is desirable to include the solvent component only to the extent necessary to obtain the desired compatibility and stability, since the solvent tends to detract from the detergent power of the composition and also, in some instances, to lower the flash point of the composition. In most instances, such solvent is present to the extent of 3 to 7 weight percent.

Compositions according to the invention also preferably contain 0.15 to 0.6 weight percent of one or more suitable fabric brighteners. Various fabric brighteners are known, and they differ in their brightening action upon different kinds of fabric. They also differ with regard to their compatibility with other components of the liquid laundry detergent being made and with regard to their stability. Especially good results have been obtained with the use of a mixture of fabric brightener F and fabric brightener G, as defined hereinbelow, but those skilled in the art will appreciate that other fabric brighteners could be substituted.

Liquid laundry-detergent compositions according to the invention may contain, if desired, 0 to 0.1 percent of a suitable dye, and 0 to 0.25 weight percent of a suitable perfume. Satisfactory results have been obtained with the use of dye K and perfume P, as defined herein, but others may be substituted.

The remainder of the liquid laundry-detergent composition according to the invention is water, which will be present in the range of 20 to 70 weight percent.

METHOD OF MIXING

In making a laundry-detergent composition in accordance with the present invention, the various ingredients discussed above are preferably mixed in a particular manner, as described below.

Separately, the sodium carboxymethylcellulose is dissolved in water, and then the alkanolamine compound is added to the aqueous solution of sodium carboxymethylcellulose.

The final step is the combining of the above-mentioned master batch with the other mixture, containing water, sodium carboxymethylcellulose, and alkanolamine.

METHOD OF USE

A liquid laundry-detergent composition according to the invention is used by being placed into a washing machine with a quantity of clothes to be cleaned. A typical and satisfactory rate of use is 480 milliliters per 100 pounds (45.36 kilograms) of clothes to be laundered.

An important consideration in connection with the use of the composition is the temperature of the water in which the clothes are laundered. It has been found that compositions of the general type described above have their best detergent effect at temperatures on the order of 49 to 60 degrees Centigrade (120 to 140 degrees Fahrenheit), which is approximately the temperature of water usually encountered in home laundries. Nonionic surfactants have a solubility in water which decreases as the temperature of the water increases. Accordingly, liquid laundry-detergent compositions according to the invention do not perform as well when the temperature of the water is raised above about 140 degrees Fahrenheit (about 60 degrees Centigrade).

On the otheer hand, satisfactory results may be obtained in some circumstances by laundering in water at cooler temperatures, such as down to about 100 degrees Fahrenheit (about 38 degrees Centigrade).

Compositions according to the invention may, of course, be used in combination with other agents usually employed in laundering clothes, such as bleaches, laundry sours, and fabric softeners.

EXAMPLES

In the examples below, "Nonionic surfactant A" is a product having an average molecular weight of 1050 and made by oxyalkylating a mixture of $C_{12}$ to $C_{16}$ alcohols with a 3:1 mixture of ethylene oxide and propylene oxide. "Nonionic surfactant B" is a product having an average molecular weight of 350 and made by oxyethylating a mixture of $C_{12}$ to $C_{15}$ alcohols.

"Fabric brightener F" is a compound of the formula

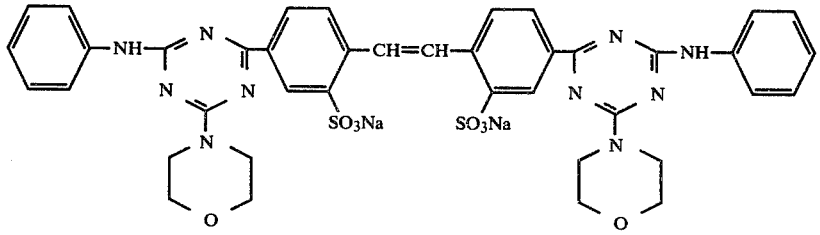

A master batch is prepared which contains the nonionic surfactant or surfactants, fabric brighteners, and, if used, the isopropanol or other solvent. Preferably this is done by heating the nonionic surfactant(s) to a suitable temperature, such as about 70–80 degrees Centigrade, and then adding the brighteners. After the fabric brighteners have dissolved, and the mixture is cooled, and the isopropanol or the like, if used, is added.

"Fabric brightener G" is a compound of the formula

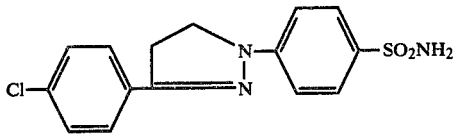

"Dye K" is a blue dye of Color Index Number 74180.

"Dye L" is a blue dye in the form of an aqueous solution of a material of Color Index Number 42045.

"Perfume P" is a floral bouquet perfume comprising various essential oils and aromatic chemicals.

"Fabric sample X" is a resin-treated blend of Dacron and cotton.

"Fabric sample Y" is a blend of Dacron and cotton, not treated with resin.

"Fabric sample Z" is cotton, not treated with resin.

The fabric samples X, Y, and Z are standard commercial test samples produced by a laboratory which supplies such material to makers or testers of detergents and/or laundry equipment. The fabric samples have unsoiled portions and other portions to which there has been uniformly applied a carbon soil.

The invention described above is illustrated by the following specific examples, in which all parts are by weight unless otherwise specified.

EXAMPLE 1

A master batch was prepared by mixing 6 parts isopropanol, 10 parts monoethanolamine, 10 parts triethanolamine, 15 parts nonionic surfactant A, and 15 parts nonionic surfactant B. To the mixture thus prepared, there were then added 0.3 parts of fabric brightener F and 0.2 parts of fabric brightener G. Separately, 0.4 parts of sodium carboxymethylcellulose were dissolved in 43.075 parts of water. This mixture was then mixed with the above-mentioned master batch and heated to 48.9 degrees Centigrade and stirred until a homogeneous emulsion resulted. The mixture was then cooled to room temperature, and to it there were then added 0.025 parts of perfume P and 0.02 parts of dye K.

The liquid laundry detergent so made was a clear, blue, somewhat viscous liquid. It had a specific gravity of 1.017, a freezing point of minus 1.11 degrees Centigrade, a flash point of 43.3 degrees Centigrade, and a pH of 11.91.

The detergent was then used in the usual manner in a household washing machine to wash a load of soiled clothes. The detergent was used at the rate of 7.9 milliliters per kilogram. Satisfactory results, comparable to those obtained with a commercially available built granular detergent, were obtained.

EXAMPLE 2

On fabric samples X, Y, and Z provided with synthetic soil, tests were conducted, comparing a liquid laundry detergent according to the invention with a commercially available built granular detergent (CABGD). Results with a commercial liquid laundry detergent (CCLD) are also presented.

A liquid laundry detergent according to the invention was made by adding 0.02 parts of dye L to 500 parts of a composition containing the following: 43.075 parts water, 0.4 parts sodium carboxymethylcellulose, 6.0 parts diethylene glycol n-butyl ether, 10 parts monoethanolamine, 10 parts triethanolamine, 15 parts nonionic surfactant A, 15 parts nonionic surfactant B, 0.2 part fabric brightener G, 0.3 part fabric brightener F, and 0.025 part perfume P. The liquid laundry detergent thus produced was a crystal-clear, blue-green solution.

Tests were conducted, using various conditions of concentration, washing time, and temperature, and using the different fabrics X, Y, and Z, mentioned above. Soil-removal and whiteness-retention values were obtained in each test. Results from a part of such testing are presented below in Table I.

In order that the data presented below may be properly understood, the manner in which the soil-removal and whiteness-retention values were obtained is explained as follows. Both values are determined by using a Hunter-Gardner reflectometer, an instrument which applies light of known wavelength and intensity to a sample area and senses the intensity of the light reflected from that sample area. In the case of the soil-removal values, the light was of a green (500 to 540 millimicrons) wavelength, and the soiled portion of the test sample was examined, before and after washing. The values ΔG are merely the difference in dial readings, before and after washing. Thus, high values of ΔG indicated good removal of soil. In the case of the whiteness-retention values, the unsoiled portions of the samples were examined, before and after washing, and ultraviolet light (300 to 400 millimicrons wavelength) was used. The percent whiteness retention equals 100 times the quotient of the dial reading after washing divided by the dial reading before washing. In some instances, in which little or no soil was washed onto the unsoiled portion and effective fabric brighteners were used, the readings after washing were higher than before, and the result was reported as a "whiteness retention" of greater than 100 percent.

Table I

| Material | Conc., g./1. | Time, Min. | Temp., °F. | Fabric | Soil Removal Value ΔG | Whiteness Retention |
|---|---|---|---|---|---|---|
| Ex. 2 | 0.2 | 20 | 120 | X | 10.5 | 99 |
| CABGD | " | " | " | X | 10.8 | 99 |
| CLLD | " | " | " | X | 10.3 | 100 |
| Ex. 2 | " | " | " | Y | 5.7 | 100 |
| CABGD | " | " | " | Y | 4.4 | 102 |
| CLLD | " | " | " | Y | 3.4 | 102 |
| Ex. 2 | " | " | " | Z | 11.1 | 105 |
| CABGD | " | " | " | Z | 10.4 | 106 |
| CLLD | " | " | " | Z | 9.5 | 106 |
| Ex. 2 | 0.4 | 15 | 140 | X | 7.2 | 97 |
| CABGD | " | " | " | X | 7.6 | 99 |
| CLLD | " | " | " | X | 8.4 | 98 |
| Ex. 2 | " | " | " | Y | 6.2 | 98 |
| CABGD | 0.4 | 15 | 140 | Y | 5.6 | 101 |
| CLLD | " | " | " | Y | 4.5 | 99 |
| Ex. 2 | " | " | " | Z | 9.0 | 100 |
| CABGD | " | " | " | Z | 8.5 | 105 |
| CLLD | " | " | " | Z | 8.8 | 104 |
| Ex. 2 | 0.26 | 13 | 136 | X | 9.4 | 97 |
| CABGD | " | " | " | X | 8.4 | 98 |
| CLLD | " | " | " | X | 7.4 | 100 |
| Ex. 2 | " | " | " | Y | 7.4 | 101 |
| CABGD | " | " | " | Y | 5.6 | 102 |
| CLLD | " | " | " | Y | 4.7 | 102 |
| Ex. 2 | " | " | " | Z | 7.8 | 104 |
| CABGD | " | " | " | Z | 8.9 | 106 |
| CLLD | 0.26 | 13 | 136 | Z | 8.1 | 107 |
| Ex. 2 | 0.4 | 20 | 120 | X | 10.1 | 102 |
| CABGD | " | " | " | X | 10.6 | 101 |
| CLLD | " | " | " | X | 8.3 | 103 |
| Ex. 2 | " | " | " | Y | 5.4 | 99 |
| CABGD | " | " | " | Y | 5.2 | 99 |
| CLLD | " | " | " | Y | 3.4 | 100 |
| Ex. 2 | " | " | " | Z | 11.6 | 108 |
| CABGD | " | " | " | Z | 9.4 | 110 |
| CLLD | " | " | " | Z | 8.8 | 107 |

Table I-continued

| Material | Conc., g./l. | Time, Min. | Temp., °F. | Fabric | Soil Removal Value ΔG | Whiteness Retention |
|---|---|---|---|---|---|---|
| Ex. 2 | 0.3 | 15 | 140 | X | 6.7 | 103 |
| CABGD | " | " | " | X | 8.7 | 104 |
| CLLD | " | " | " | X | 8.6 | 104 |
| Ex. 2 | 0.3 | 15 | 140 | Y | 7.3 | 105 |
| CABGD | " | " | " | Y | 5.7 | 106 |
| CLLD | " | " | " | Y | 2.9 | 103 |
| Ex. 2 | " | " | " | Z | 13.0 | 109 |
| CABGD | " | " | " | Z | 8.2 | 112 |
| CLLD | " | " | " | Z | 6.9 | 112 |
| Ex. 2 | 0.2 | 10 | 160 | X | 4.6 | 94 |
| CABGD | " | " | " | X | 10.2 | 101 |
| CLLD | " | " | " | X | 5.8 | 101 |
| Ex. 2 | " | " | " | Y | 4.7 | 99 |
| CABGD | " | " | " | Y | 4.2 | 103 |
| CLLD | " | " | " | Y | 3.9 | 103 |
| Ex. 2 | " | " | " | Z | 1.6 | 100 |
| CABGD | 0.2 | 10 | 160 | Z | 7.5 | 104 |
| CLLD | " | " | " | Z | 6.2 | 105 |

The foregoing results demonstrate that in accordance with the present invention there is obtained a liquid laundry detergent which, under many conditions of use, performs substantially as well as the commercially available built granular detergent. The data also show that the material of the present invention performs substantially better at lower washing temperatures, and may not give good performance at a high temperature, such as 160 degrees Fahrenheit (about 71 degrees Centigrade).

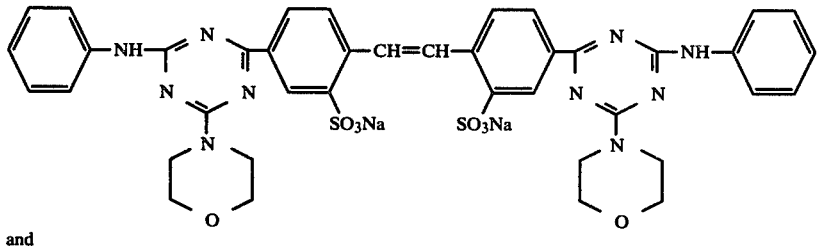

and

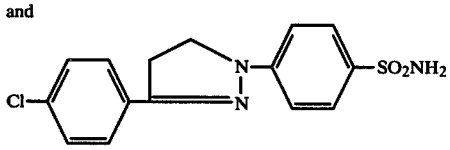

EXAMPLE 3

There was also prepared a liquid laundry-detergent composition which was made as follows. To a clean mixer, there were added 64.8835 parts of tap water at about 30 degrees Centigrade and 0.26 parts of sodium carboxymethylcellulose, and the mixture was stirred until the carboxymethylcellulose was completely dissolved. Then, 9.28 parts of "PLURAFAC B-26" surfactant were added and mixed until dispersed. Next, 9.28 parts of "PLURAFAC RA-30" surfactant were added and mixed until dispersed. Then 0.19 part of fabric brightener F was added, and the mixture was brought to a temperature of 71 degrees Centigrade and mixed until a homogeneous emulsion resulted. This operation takes on the order of one-half to one hour. Then the mixture was cooled to 36.5 degrees Centigrade, and there were added 6.18 parts each of monoethanolamine and triethanolamine, which were mixed in until dispersed. Then 3.72 parts of isopropyl alcohol were added, and lastly 0.25 parts of perfume P and 0.0015 part of dye K. Mixing was continued until a uniform blue solution resulted.

This yields a liquid laundry-detergent which may be used in place of that of Example 1 or Example 2. Owing to its higher water content, the composition of this example may be injected somewhat more readily into commercial laundry machines which operate upon a metered amount of liquid laundry detergent.

While there have been shown and described herein certain embodiments of the invention, it is intended that there be covered as well any change or modification therein which may be made without departing from the spirit and scope of the invention.

The embodiments of the invention in which an exclusive property or privilege is claimed are defined as follows:

1. A liquid fabric-cleaning detergent consisting essentially of
   a. from 15 to 30 weight percent of at least one nonionic surfactant having an HLB of 5 to 14,
   b. from 0.15 to 0.50 weight percent of sodium carboxymethylcellulose,
   c. from 10 to 30 weight percent of a lower alkanolamine effective to promote the action of said nonionic surfactant, and
   d. water in an amount of 20 to 70 weight percent.

2. A method of laundering fabric which comprises agitating said fabric and water at a temperature of 49 to 60 degrees Centigrade with an effective amount of a liquid fabric-cleaning detergent as defined in claim 1.

3. A detergent according to claim 1, wherein said detergent further contains amounts effective to brighten fabric of fabric brighteners having the formulae 4. A method of laundering fabric which comprises agitating said fabric and water at a temperature of 49 to 60 degrees Centigrade with an effective amount of a liquid fabric-cleaning detergent as defined in claim 3.

5. A detergent according to claim 3, said detergent containing 3 to 7 weight percent of a solvent component consisting essentially of a substance selected from the group consisting of isopropanol, diethylene glycol n-butyl ether, diethylene glycol ethyl ether, ethanol, n-propanol, 2-ethoxyethanol, and 2-butoxyethanol, and mixtures thereof.

6. A method of laundering fabric which comprises agitating said fabric and water at a temperature of 49 to 60 degrees Centigrade with an effective amount of a liquid fabric-cleaning detergent as defined in claim 5.

7. A detergent according to claim 5, said detergent containing at least 10 weight percent of triethanolamine.

8. A method of laundering fabric which comprises agitating said fabric and water at a temperature of 49 to 60 degrees Centigrade with an effective amount of a liquid fabric-cleaning detergent as defined in claim 7.

9. A detergent according to claim 7, wherein said nonionic surfactant component comprises a mixture of a first nonionic surfactant having an average molecular weight of 1050 and made by oxyalkylating a mixture of alcohols containing 12 to 16 carbon atoms with a 3:1 mixture of ethylene oxide and propylene oxide, and a second nonionic surfactant having an average molecular weight of 350 and made by oxyethylating a mixture of alcohols containing 12 to 15 carbon atoms.

10. A method of laundering fabric which comprises agitating said fabric and water at a temperature of 49 to 60 degrees Centigrade with an effective amount of a liquid fabric-cleaning detergent as defined in claim 9.

11. A detergent according to claim 1, wherein said detergent further contains an effective amount of at least one compatible fabric brightener.

12. A liquid fabric-cleaning detergent consisting essentially of a. from 15 to 30 weight percent nonionic surfactant components consisting of at least one nonionic surfactant having an HLB value of 4 to 17, b. from 0.15 to 0.50 weight percent of sodium carboxymethylcellulose, c. from 10 to 30 weight percent of lower alkanolamine component containing an amount of alkanolamine effective to promote the action of said nonionic surfactant component, d. from 3 to 7 weight percent of solvent component consisting essentially of a substance selected from the group consisting of isopropanol, diethylene glycol n-butyl ether, diethylene glycol ethyl ether, ethanol, n-propanol, 2-ethoxyethanol, and 2-butoxyethanol, and mixtures thereof, and e. water in an amount of 20 to 70 weight percent.

13. A method of laundering fabric which comprises agitating said fabric in water at a temperature of 49 to 60 degrees Centigrade with an effective amount of a liquid fabric-cleaning detergent as defined in claim 12.

14. A detergent according to claim 12, said detergent containing at least about 10 weight percent of triethanolamine.

15. A method of laundering fabric which comprises agitating said fabric in water at a temperature of 49 to 60 degrees Centigrade with an effective amount of a liquid fabric-cleaning detergent as defined in claim 14.

16. A detergent according to claim 14, wherein said nonionic surfactant component comprises a mixture of a first nonionic surfactant having an average molecular weight of 1050 and made by oxyalkylating a mixture of alcohols containing 12 to 16 carbon atoms with a 3:1 mixture of ethylene oxide and propylene oxide, and a second nonionic surfactant having an average molecular weight of 350 and made by oxyethylating a mixture of alcohols containing 12 to 15 carbon atoms.

17. A method of laundering fabric which comprises agitating said fabric and water at a temperature of 49 to 60 degrees Centigrade with an effective amount of a liquid fabric-cleaning detergent as defined in claim 10.

18. A liquid fabric-cleaning detergent consisting essentially of, in parts by weight:

10 parts monoethanolamine, 10 parts triethanolamine, 6 parts of a solvent selected from the group consisting of isopropanol and diethylene glycol n-butyl ether, 15 parts of a nonionic surfactant having an average molecular weight of 1050 and made by oxyalkylating a mixture of $C_{12}$ to $C_{16}$ alcohol with a 3:1 mixture of ethylene oxide and propylene oxide, 15 parts of a nonionic surfactant having an average molecular weight of 350 and made by oxyethylating a mixture of $C_{12}$ to $C_{15}$ alcohols, 0.3 parts of a fabric brightener having the formula

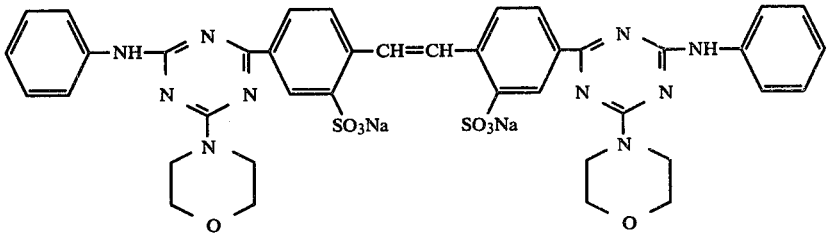

0.2 parts of a fabric brightener having the formula

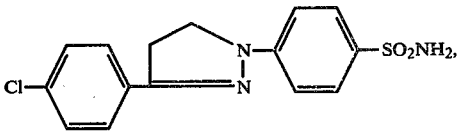

0.4 parts of sodium carboxymethylcellulose, and 43.075 parts water.

* * * * *